US006167851B1

(12) United States Patent
Bowling

(10) Patent No.: US 6,167,851 B1
(45) Date of Patent: Jan. 2, 2001

(54) MOVABLE CRANKPIN, VARIABLE COMPRESSION-RATIO, PISTON ENGINE

(76) Inventor: William M. Bowling, 5321 E. Calle Del Medio, Phoenix, AZ (US) 85018

( * ) Notice: Under 35 U.S.C. 154(b), the term of this patent shall be extended for 0 days.

(21) Appl. No.: 09/358,572

(22) Filed: Jul. 12, 1999

Related U.S. Application Data

(60) Provisional application No. 60/093,205, filed on Jul. 15, 1998.

(51) Int. Cl.[7] ..... F02B 75/04

(52) U.S. Cl. ..... 123/48 B

(58) Field of Search ..... 123/48 R, 48 B, 123/78 E, 78 F, 197.4, 197.3, 197.1; 92/12.2, 13.3; 91/504

(56) References Cited

U.S. PATENT DOCUMENTS

| | | | | |
|---|---|---|---|---|
| 862,603 | * | 8/1907 | Benckendorf | 123/48 B |
| 5,040,502 | * | 8/1991 | Lassiter | 123/197.4 |
| 5,201,287 | * | 4/1993 | Blish | 123/48 B |
| 5,394,839 | * | 3/1995 | Haneda | 123/53.1 |

* cited by examiner

*Primary Examiner*—Andrew M. Dolinar
*Assistant Examiner*—Hai Huynh

(57) ABSTRACT

A movable crankpin, variable-compression ratio, piston engine with movable counterweights so as to eliminate engine imbalance during displacement and compression ratio change. Compression ratio may be changed manually or automatically without stopping and restarting the engine.

4 Claims, 3 Drawing Sheets

MOVABLE CRANKPIN, VARIABLE COMPRESSION-RATIO, PISTON ENGINE

This Application claims the benefit of U.S. Provisional No. 60/093,205 filed Jul. 15, 1998

BACKGROUND—FIELD OF INVENTION

This invention relates to internal-combustion, piston engines, specifically to an engine which utilizes variable stroke and displacement to achieve variable compression ratio.

BACKGROUND—DISCUSSION OF PRIOR ART

Variable-compression ratio engines have been proposed, and a few built, since 1890. None achieved commercial success since gains did not justify the added complications to the engine. With the advent of turbocharging, variable-compression ratio engines became more attractive; high compression ratios for economy at low loads and low compression ratios, permitting very high supercharge pressures, at high loads. These benefits apply to both compression-ignition (CI) and spark-ignition (SI) engines and to two-stroke cycle and four-stroke cycle engines.

Variable-compression ratio mechanisms generally fall into two categories; variable displacement and essentially constant displacement, variable headspace. Variable displacement, the category of the present invention, has been achieved in the past by using nutating devices or multi-bar linkages. For example, U.S. Pat. Nos. 3,939,809, 4,112,826, 4,270,495, 4,144,771 and 4,066,049. Both approaches are mechanically complex and differ substantially from common crankshaft and connecting rod, fixed compression-ratio designs. Mechanical complexity increases costs and reduces reliability and durability. Divergence from traditional design requires retooling and increases costs.

Since the mid-1960's, government mandated emission limits and automotive mileage requirements have changed engine design climate for both CI and SI engines. What were once exotic engine systems, variable valve timing, fuel injection, electronically controlled ignition and catalytic converters, are now commonplace in efforts to improve engine efficiency and reduce engine physical size and weight and reduce emissions.

A fully controllable-during-operation, variable-compression ratio engine offers advantages in addition to improved efficiency at low load and the ability to operate at very high load. Some of these advantages are:

(a) operation on a variety of fuels with the ability to change fuels without stopping and restarting the engine;

(b) operation on either CI or SI cycle with the ability to change cycles without stopping and restarting the engine;

(c) complement valve, fuel and ignition timing to enhance pollution control.

OBJECTS AND ADVANTAGES

Accordingly, several objects and advantages of the present invention are:

(a) to provide for a variable compression-ratio engine using standard pistons and connecting rods;

(b) to provide for automatic or manual control of engine compression ratio based on any selected condition, internal or external to an engine;

(c) to provide for multi-fuel engine operation without the need to stop and restart an engine;

(d) to provide for a very high-output engine;

(e) to improve moderate-to-low-load engine efficiency;

(f) to provide for changing engine operating cycle without the need to stop and restart an engine;

(g) to enhance engine pollution control;

(h) to provide a variable compression-ratio engine capable of operating on either two-stroke or four-stroke cycles.

Still further objects and advantages will become apparent from a consideration of the ensuing description and drawings.

DRAWING FIGURES

REFERENCE NUMERALS IN THE DRAWINGS

Figure 1:
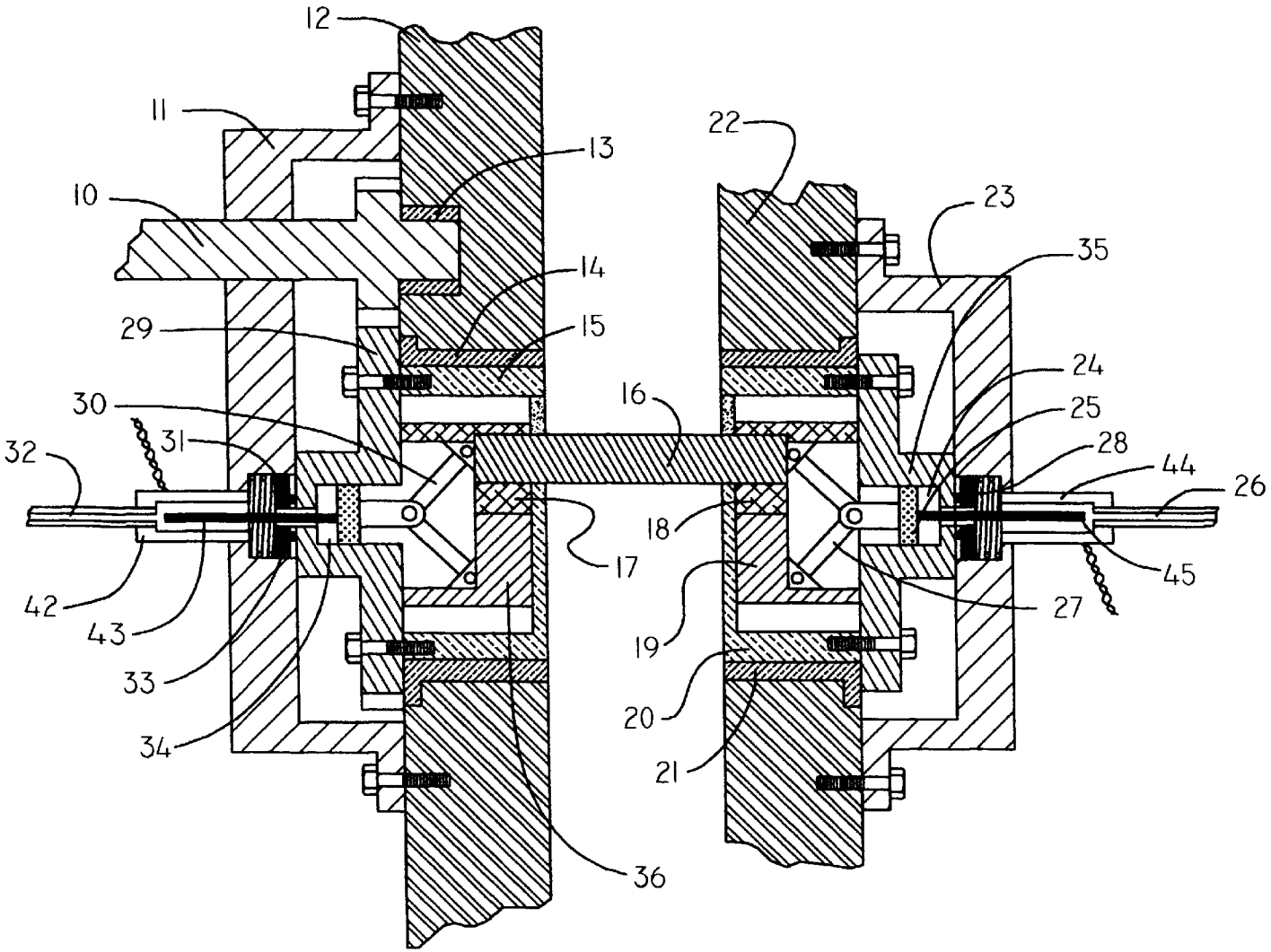
FIG. 1 shows a partial cross-sectional view of a crankcase, crankshaft and one actuation means of the present invention.

10 output shaft
11 front cover
12 crankcase front section
13 output shaft bearing
14 crankshaft front main bearing
15 crankshaft front journal/block housing
16 crankpin
17 front crankpin block
18 rear crankpin block
19 rear counterweight block
20 crankshaft rear journal/block housing
21 crankshaft rear main bearing
22 crankcase rear section
23 rear cover
24 rear actuator cylinder
25 rear actuator piston
26 rear actuator oil line
27 rear actuator linkage
28 rear oil seal
29 front actuator cylinder housing
30 front actuator linkage
31 front actuator piston
32 front actuator oil line
33 front oil seal
34 front actuator cylinder
35 rear actuator cylinder housing
36 front counterweight block
37 rear actuator shaft
38 rear actuator coupling
39 front actuator coupling
40 front actuator shaft
42 front actuator-position sensor

43 front position-sensor rod

44 rear actuator-position sensor

45 rear position-sensor rod

DESCRIPTION—FIGS. 1, 2 AND 3

A typical embodiment of a crankcase and crankshaft for a single throw, sliding crankpin, variable compression-ratio, piston engine of the present invention is shown in FIG. 1, partial cross-sectional view. A crankpin 16 is attached into front and rear crankpin blocks 17 and 18, respectively. Front crankpin block 17 is attached to a front actuator piston 31 by a front actuator linkage 30 and is free to slide radially in a crankshaft front journal/block housing 15. Crankcase front journal/block housing 15 rotates in a crankshaft front main bearing 14. Rear crankpin block 18 is attached to a rear actuator piston 25 by a rear actuator linkage 27 and is free to slide radially in a crankshaft rear journal/block housing 20. Crankcase rear journal/block housing 20 rotates in a crankshaft rear main bearing 21. A front counterweight block 36 is attached to front actuator piston 31 by front actuator linkage 30 and is free to slide radially in crankshaft front journal/block housing 15. A rear counterweight block 19 is attached to rear actuator piston 25 by rear actuator linkage 27 and is free to slide radially in crankshaft rear journal/block housing 20.

Front actuator piston 31 is enclosed in a front actuator cylinder housing 29 and they define a front actuator cylinder 34. Front actuator cylinder housing 29 is fastened to front crankcase journal/block housing 15. Front crankcase journal/block housing 15 has circumferential gear teeth which mesh with the gear teeth of an output shaft 10. Output shaft 10 rotates in an output shaft bearing 13. Rear actuator piston 25 is enclosed in a rear actuator cylinder housing 35 and they define a rear actuator cylinder 24. Rear actuator cylinder housing 35 is fastened to crankcase rear journal/block housing 20.

A front actuator oil line 32 is attached to a front actuator-position sensor 42 which is attached to a front cover 11. Cover 11 is attached to a crankcase front section 12 and encloses a front oil seal 33. A rear actuator oil line 26 is attached to a rear actuator-position sensor 44 which is attached to a rear cover 23. Rear cover 23 is attached to a crankcase rear section 22 and encloses a rear oil seal 28.

A front position-sensor rod 43 is attached to front actuator piston 31 and extends through front oil seal 33 into front actuator-position sensor 42. A rear position-sensor rod 45 is attached to rear actuator piston 25 and passes through rear oil seal 28 into rear actuator-position sensor 44.

Figure 2:
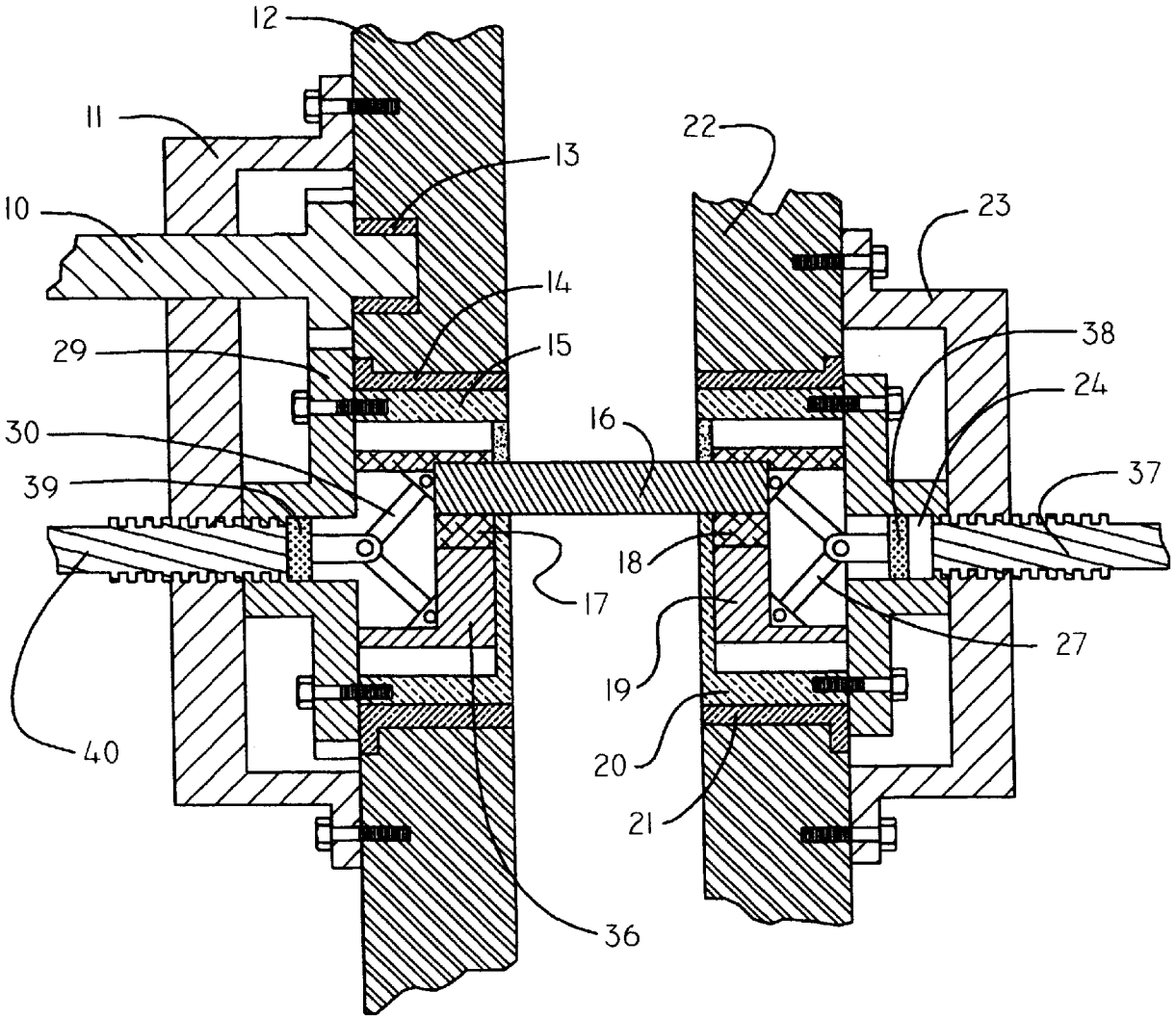
FIG. 2 shows a partial cross-sectional view of one alternative actuation means.

FIG. 2 shows a cross-sectional view of one alternate crankpin block and counterweight block actuation method. A rear actuation shaft 37 is threaded through rear cover 23 and is attached to rear actuator linkage 27 by a rear actuator coupling 38. A front actuator shaft 40 is threaded through front cover 11 and is attached to front linkage 30 by a front coupling 39.

Figure 3:
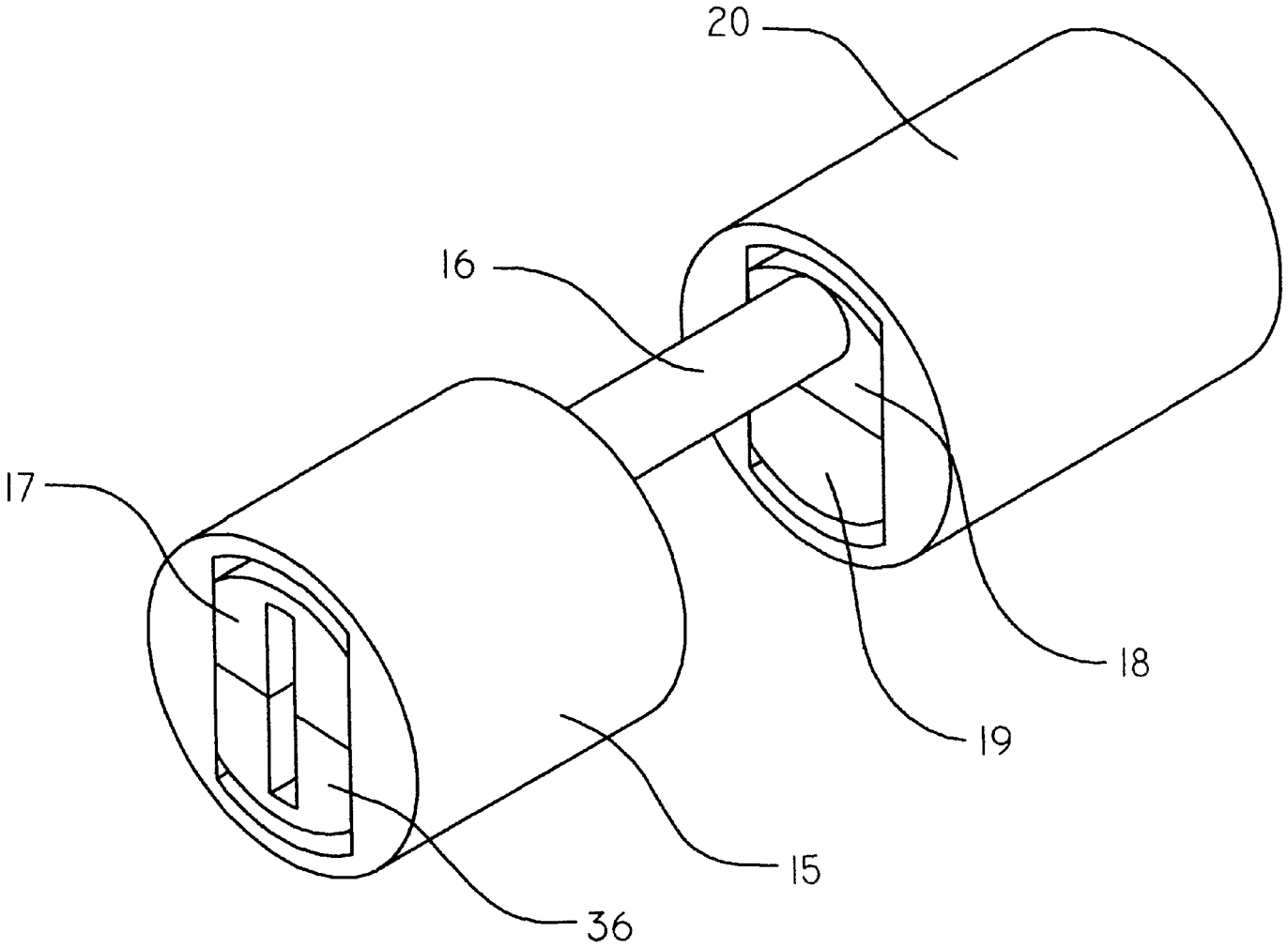
FIG. 3 shows an isometric view of a crankshaft of the present invention with sliding crankpin blocks and sliding counterweights.

FIG. 3 shows an isometric view of the mechanism core. Front crankpin block 17 and front counterweight block 36 are assembled into crankcase front journal/block housing 15. Rear crankpin block 18 and rear counterweight block 19 are assembled into crankcase rear journal/block housing 20. Crankpin 17 is assembled into front and rear crankpin blocks 17 and 18 respectively.

Operation

In operation the present invention achieves variable compression ratio by varying engine stroke length and displacement. In FIG. 1 oil from front controllable-pressure oil source 41 flows through front actuator oil line 32, front actuator-position sensor and front oil seal 33 into front actuator cylinder 34. Oil from rear controllable pressure oil source 46 flows through rear actuator oil line 26, rear actuator-position sensor 44, and rear oil seal 28 into rear actuator cylinder 24. Pressure is then exerted on front and rear actuator pistons 31 and 25. As pistons 31 and 25 move in response to oil pressure, they move front and rear linkages 30 and 27 which move front and rear crankpin blocks 17 and 18 and front and rear counterweight blocks 36 and 19 radially in crankcase front and rear journal/block housings 15 and 20.

Prior to starting the engine, front and rear controllable pressure oil sources, not shown, are activated and predetermined pressures developed and applied to both front and rear actuator pistons 31 and 25 through front and rear actuator oil lines 32 and 26, front and rear actuator-position sensors 42 and 44 and front and rear oil seals 33 and 28. This pressure is a function of desired compression ratio. As a starting device begins to turn output shaft 10, crankpin 16 rotates and reciprocates pistons via connecting rods. Pistons and connecting rods are not shown as these mechanisms are well known to those familiar with the art. As pistons rise on engine compression stroke, compression pressure on pistons is transmitted radially inward through connecting rods, crankpin 16, front and rear crankpin blocks 17 and 18 and front and rear actuator linkages 30 and 27 to front and rear actuator pistons 31 and 25.

As front and rear actuator pistons 31 and 25 move, attached position-sensor rods 43 and 45 move within front and rear actuator-positions sensors 42 and 44 which provide position feedback for manual or automatic controllers. The controllers assure that front and rear actuator pistons move synchronously and that the desired compression ratio is maintained.

If compression pressure overbalances oil pressure on actuator pistons 31 and 25, stroke and compression ratio will be reduced as actuator pistons 31 and 25 are moved axially outward permitting crankpin blocks 17 and 18, crankpin 16 and counterweight blocks 19 and 36 to slide radially inward. If it is desired to increase compression ratio, pressure from front and rear controllable pressure oil sources are increased causing front and rear actuator pistons 31 and 25 to move axially inward. Crankpin blocks 17 and 18, crankpin 16 and counterweights 36 and 19 are thus moved radially outward lengthening engine stroke and increasing compression ratio. Equal and opposite-direction movement of counterweights 36 and 19 versus crankpin blocks 17 and 18 and crankpin 16 assure there is no engine imbalance because of stroke variations.

One alternative actuation method is shown in FIG. 2. Controllable-position motors, such as electric stepper motors, synchronously rotate front and rear actuator shafts 40 and 37. Threads on shafts 40 and 37 engage threads in covers 11 and 23 cause shafts 40 and 37 to move axially inward or outward, depending on the direction of shaft rotation, and move linkages 30 and 27 through couplings 38 and 39. If increased compression ratio is desired, shafts 37 and 40 are rotated so as to drive them axially inward and move crankpin blocks 17 and 18, crankpin 16 and counterweights 36 and 19 radially outward. Stroke and compression ratio are increased. Shaft 40 and 37 rotations are reversed to reduce stroke and compression ratio.

Summary, Ramifications and Scope

Accordingly, the reader will see that the movable crankpin and counterweights of this invention provide for an engine that can change compression ratio by changing stroke length, manually or automatically, in response to an unlimited number and variety of control inputs based on conditions internal or external to the engine. The reader will also see that changes in stroke length do not cause any engine imbalance and that the invention is equally applicable to two and four-stroke cycle engines.

Additionally, the reader will see that the present invention offers many engine operating characteristic advantages, such as;

(a) operation on a variety of fuels by changing the compression ratio to match fuel requirements and to accomplish this without stopping and restarting the engine, (b) high output per unit of engine displacement in either CI or SI engines by lowering the compression ratio so that very high supercharge/turbocharge pressures can be used without causing overly high combustion pressures in CI engines or pre-ignition in SI engines, (c) improved efficiency at low-to-moderate power output in either CI or SI engines by raising the compression ratio to enhance ignition characteristics and optimize combustion pressures, (d) the ability to change from CI to SI cycle operation, or vice-versa, without stopping and restarting the engine by changing compression ratio to match that required by the operating acycle selected, (e) enhanced control of engine emissions, particularly when combined with valve, fuel and ignition timing.

While the above description contains many specificities, these should not be construed as limitations on the scope of the invention, but rather as an example of preferred embodiments thereof. Other variations are possible. For example;

(1) the mechanism for moving crankpin blocks and counterweights may be wedges, rather than linkages, (2) the mechanism for moving crankpin blocks and counterweights may be cams, rather than linkages, (3) the mechanism for moving crankpin blocks and counterweights may be radial screws, rather than linkages.

Accordingly, the scope of the invention should be determined not by the embodiment(s) illustrated, but by the appended claims and their legal equivalents.

I claim:

1. A mechanism for providing variable compression ratio in an internal combustion, piston engine, said mechanism consisting of movable crankpin blocks, within crankshaft journals, supporting a crankpin, opposite-moving counterweights, within crankshaft journals, and a means of moving said crankpin blocks, said crankpin and said counterweights.

2. The mechanism of claim 1 further including position sensors to indicate the position of the crankpin blocks so as to enable them to be synchronised and to indicate stroke position, and consequently, compression ratio.

3. The mechanisms of claim 1 or 2 wherein said means of moving said crankpin blocks, said crankpin and said counterweights is controlled manually.

4. The mechanisms of claim 1 or 2 wherein said means of moving said crankpin blocks, said crankpin and said counterweights is controlled automatically.

* * * * *